US005183381A

United States Patent [19]

McKean

[11] Patent Number: 5,183,381

[45] Date of Patent: * Feb. 2, 1993

[54] VARIABLE GEOMETRY TURBINE INLET WALL MOUNTING ASSEMBLY

[75] Inventor: Peter S. McKean, Huddersfield, England

[73] Assignee: Holset Engineering Company Limited, Huddersfield, England

[ * ] Notice: The portion of the term of this patent subsequent to Jan. 15, 2008 has been disclaimed.

[21] Appl. No.: 641,208

[22] Filed: Jan. 15, 1991

Related U.S. Application Data

[63] Continuation-in-part of Ser. No. 352,094, May 15, 1989, Pat. No. 4,984,965.

[30] Foreign Application Priority Data

May 17, 1988 [GB] United Kingdom ..... 8811621

[51] Int. Cl.[5] ..... F01D 17/12

[52] U.S. Cl. ..... 415/150; 415/155; 415/165; 403/375

[58] Field of Search ..... 415/148, 150, 151, 155, 415/156, 157, 165; 403/375; 285/61

[56] References Cited

U.S. PATENT DOCUMENTS

| | | | |
|---|---|---|---|
| 3,079,127 | 2/1963 | Rowlett et al. | 415/150 |
| 4,403,913 | 9/1983 | Fisker | 415/150 |
| 4,544,325 | 10/1985 | Rogo et al. | 415/150 |
| 4,552,308 | 11/1985 | Rogo et al. | 415/150 |
| 4,984,965 | 1/1991 | McKean | 415/155 |

*Primary Examiner*—Edward K. Look
*Assistant Examiner*—Hoang Nguyen
*Attorney, Agent, or Firm*—Gary M. Gron

[57] ABSTRACT

A mounting assembly for a movable annular wall member of an inlet passageway of a variable geometry turbine. The inlet passageway is defined between the movable wall and a facing wall. The wall member is formed from a sheet material and is supported on a plurality of pins which extend parallel to the direction of movement of the wall member. The wall member comprises a tubular portion extending away from the facing wall and each pin supports a radial extending projection having a pair of spaced tabs. Each tab is engaged in a respective slot in the tubular portion of the wall member, the tabs being a relatively close fit in the direction of movement of the wall member and a relatively loose fit in a plane at right angles to the direction of movement.

5 Claims, 6 Drawing Sheets

VARIABLE GEOMETRY TURBINE INLET WALL MOUNTING ASSEMBLY

This is a Continuation-In-Part of U.S. application Ser. No. 352,094 filed on May 15, 1989 and entitled Variable Geometry Turbine Inlet Wall Mounting Assembly now, U.S. Pat. No. 4984965.

The present invention relates to a mounting assembly and in particular to a mounting assembly for a movable annular wall member of an inlet passageway of a variable geometry turbine.

Turbines generally comprise a turbine wheel mounted in a turbine housing, an annular inlet passageway arranged around the turbine chamber, an inlet chamber arranged around the inlet passageway, and an outlet passageway extending form the turbine chamber. The passageways and chambers communicate such that pressurized gas admitted to the inlet chamber flows through the inlet passageway to the outlet passageway across the turbine wheel, thereby causing it to rotate. In a variable geometry turbine, one wall of the inlet passageway may be defined by an annular wall member movable relative to an opposing annular wall of the inlet passageway to control the effective area of the inlet passageway.

Several known variable geometry turbine arrangements are described in U.S. Pat. No. 4,499,732 and U.S. Pat. No. 4,557,665. In the described arrangements a thin walled annular wall member is supported on a pair of guide pins which extend parallel to and are slidable parallel to the axis of rotation of the turbine wheel. Each pin is acted upon by a respective actuator. The pins are connected to the thin walled annular wall member in such a way that relative movement between the pins and the portions of the wall member to which they are connected is not possible.

The movable wall member is exposed to repeated rapid and large changes in temperature. As a result some thermal distortion and expansion of the wall member is inevitable. This distortion can apply transverse forces to the guide pins, increasing the probability of that they may bind.

It is an object of the present invention to provide a mounting assembly for a movable annular wall member of a variable geometry turbine which minimizes or even eliminates the problems outlined above.

According to the present invention there is provided a mounting assembly for a movable annular wall member of an annular inlet passageway of a variable geometry turbine, wherein the inlet passageway is defined between the movable wall and an opposed wall. The wall member is formed from a sheet material, which is supported on a plurality of guide elements which extend parallel to its direction of movement. Means are provided to interconnect the wall member and the guide elements with a relatively close fit in the direction of movement and a relatively loose fit in a plane at right angles to the direction of movement.

The above and other related objects and features of the present invention will be apparent from a reading of the following description of the disclosure found in the accompanying drawings and the novelty thereof pointed out in the appended claims.

Figure 1:
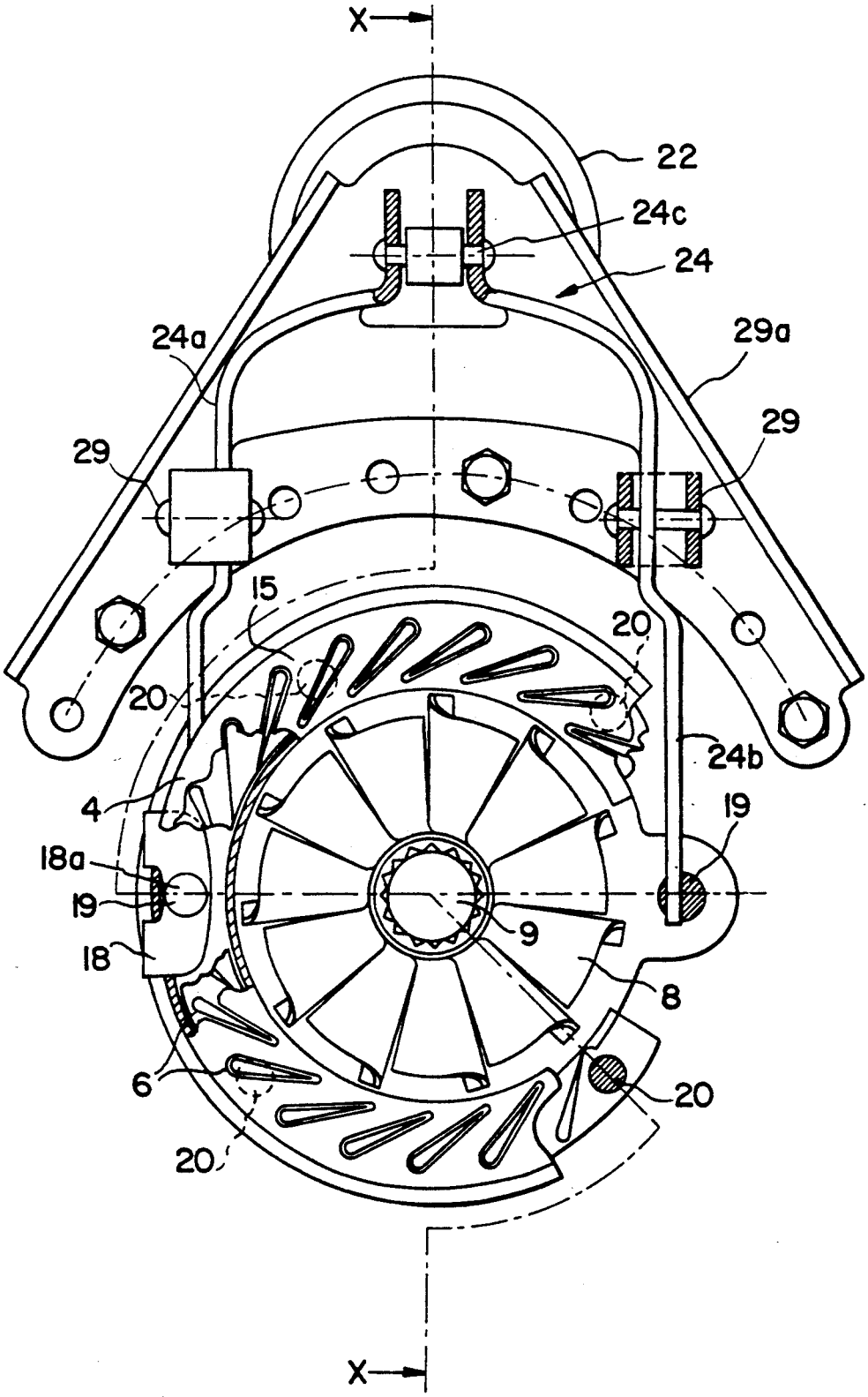
FIG. 1 is a partially cut-away view looking along the axis of a variable geometry turbine in accordance with the present invention, the view showing axially spaced features of the turbine and the turbine housing 1 removed.

Referring now to FIGS. 1 to 4, the illustrated variable geometry turbine comprises a turbine housing 1 defining a volute or annular inlet 2 to which exhaust gas from an internal combustion engine (not shown) is delivered. The exhaust gas flows from the annular inlet chamber 2 toward an axially extending outlet passageway 3 via an inlet passageway defined on one side by a movable annular member 4 and on the other side by an opposing wall 5. A centripetal turbine wheel 8 is mounted on shaft 9, journaled for rotation in a bearing housing 9*a* by spaced bearings 10*a* and 10*b*. Gas flowing from the inlet passageway 2 toward the outlet passageway 3 passes over the turbine wheel 8 and as a result a torque is applied to the shaft 9 which in turn drives a centrifugal compressor wheel 10 mounted in housing 10*a*. Rotation of the compressor wheel 10 pressurizes ambient air present in an air inlet 11 and delivers the pressurized air to an air outlet or volute 12. That pressurized air is fed to an internal combustion engine (not shown).

The movable annular wall member 4 comprises a radially inner tubular wall 14, a radially extending annular portion 15, a radially outer tubular portion 16, and a radially extending flange 17. The radially outer tubular portion 16 is engaged by two diametrically opposed interconnecting means 18 which are supported on respective guide pins 19, as described later. An array of nozzle vanes 6, supported on a nozzle support ring 7, extends through slots 6*a* (see FIG. 1) in the portion 15 and into the annular inlet passageway. A sealing ring 13 is received in a radially inward facing annular groove 13*a* on the turbine housing 1 and bears against the periphery of outer tubular portion 16.

The nozzle support ring 7 is mounted on an array of four guide pins 20 received in bores 20*a* in bearing housing 9*a* so as to be movable parallel to the axis of rotation of the turbocharger. Each of the guide pins 20 is biased towards the right (in FIGS. 2 to 4) by a compression spring 21 received in bores 20*a* and acting on the pins 20. Thus, the nozzle support ring 7 and the vanes 6 mounted on it are biased towards the right in FIGS. 2 to 4 and accordingly normally assume the position shown in FIG. 2, with the free ends 6*b* of the vanes 6 bearing against the facing wall 5 of the inlet passageway.

Figure 2:
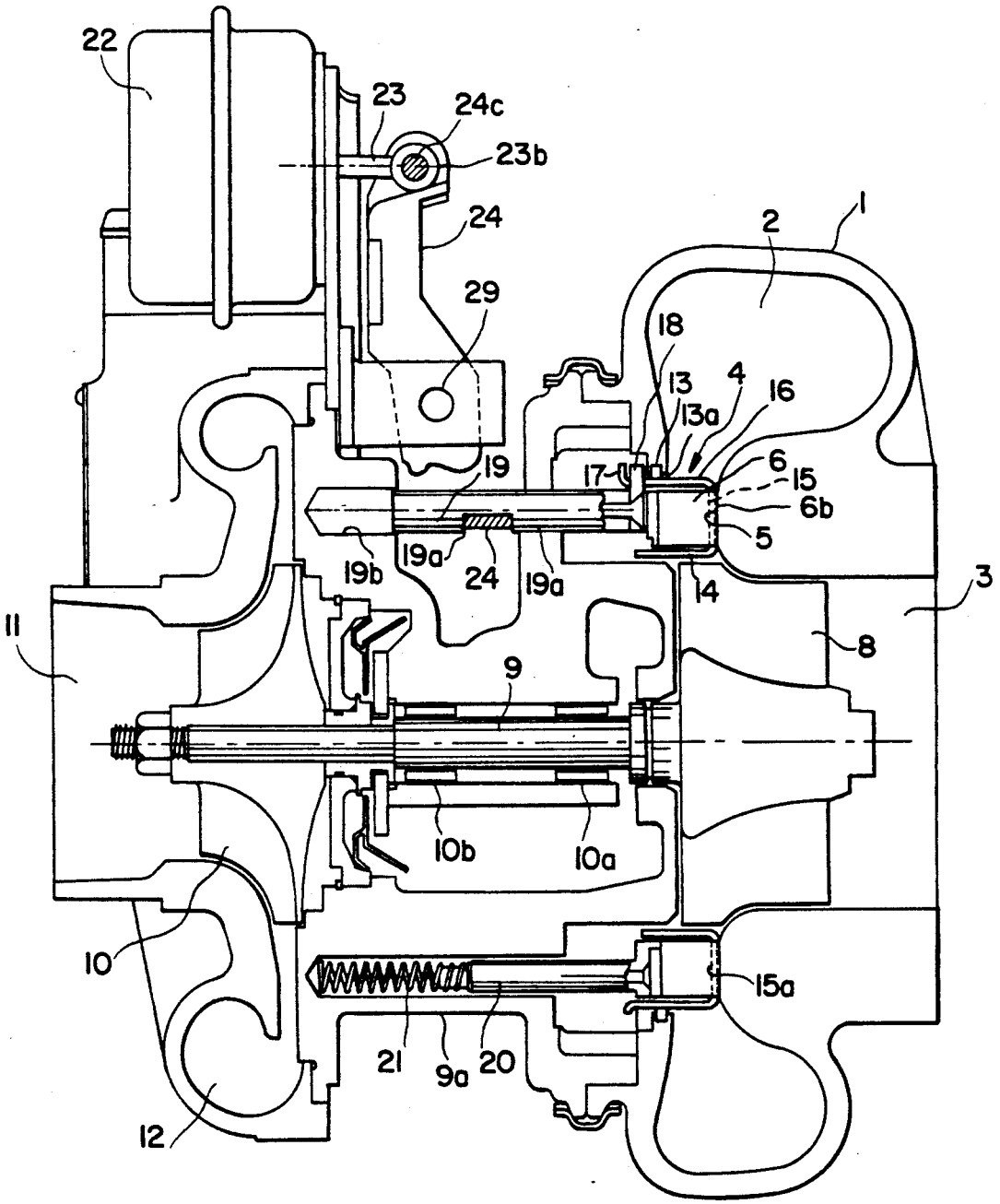
FIGS. 2, 3 and 4 are sectional views taken on the line X—X of FIG. 1 with components of the assembly of FIG. 1 shown respectively in the fully closed, half closed and fully open positions.
Figure 3:
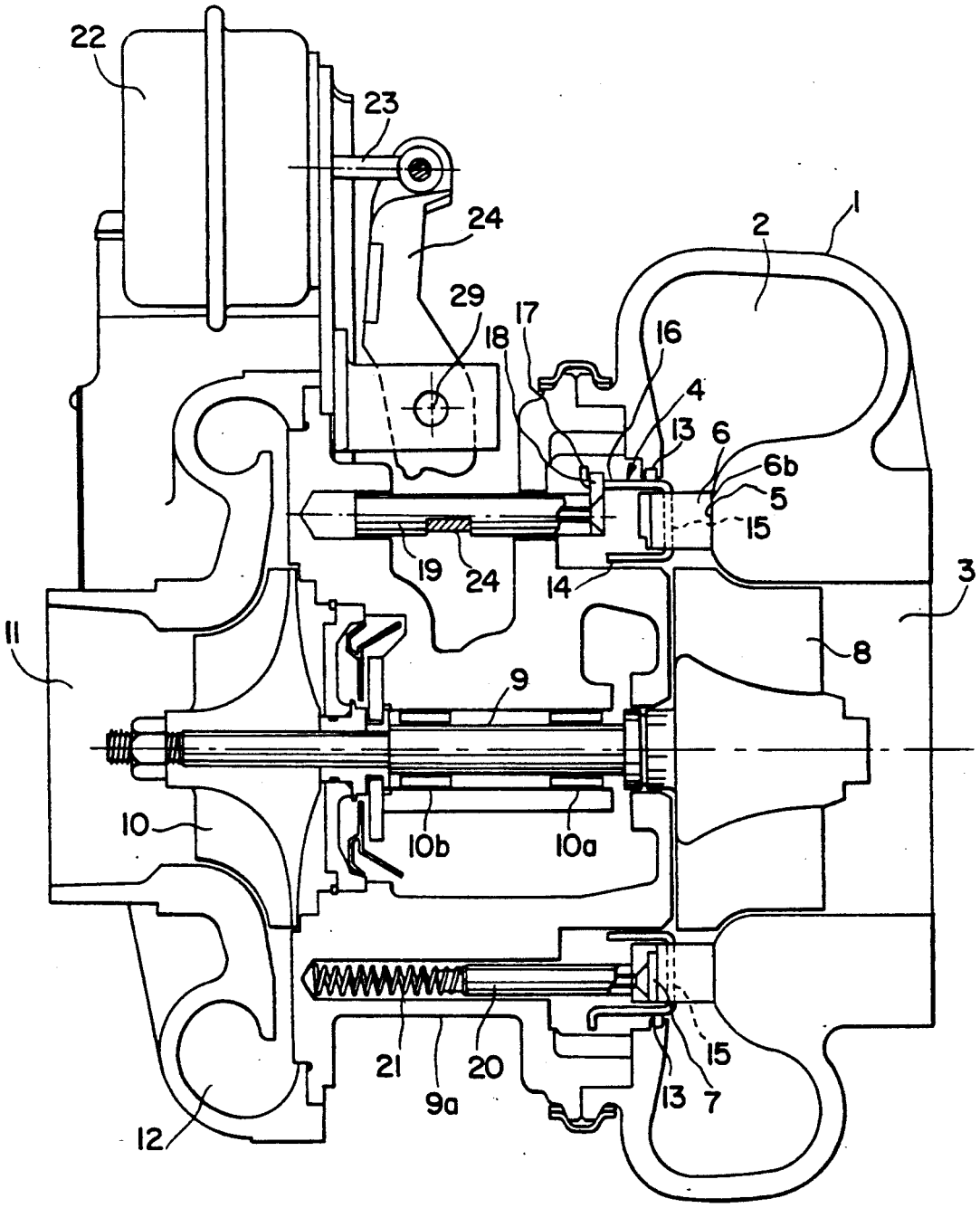
Figure 4:
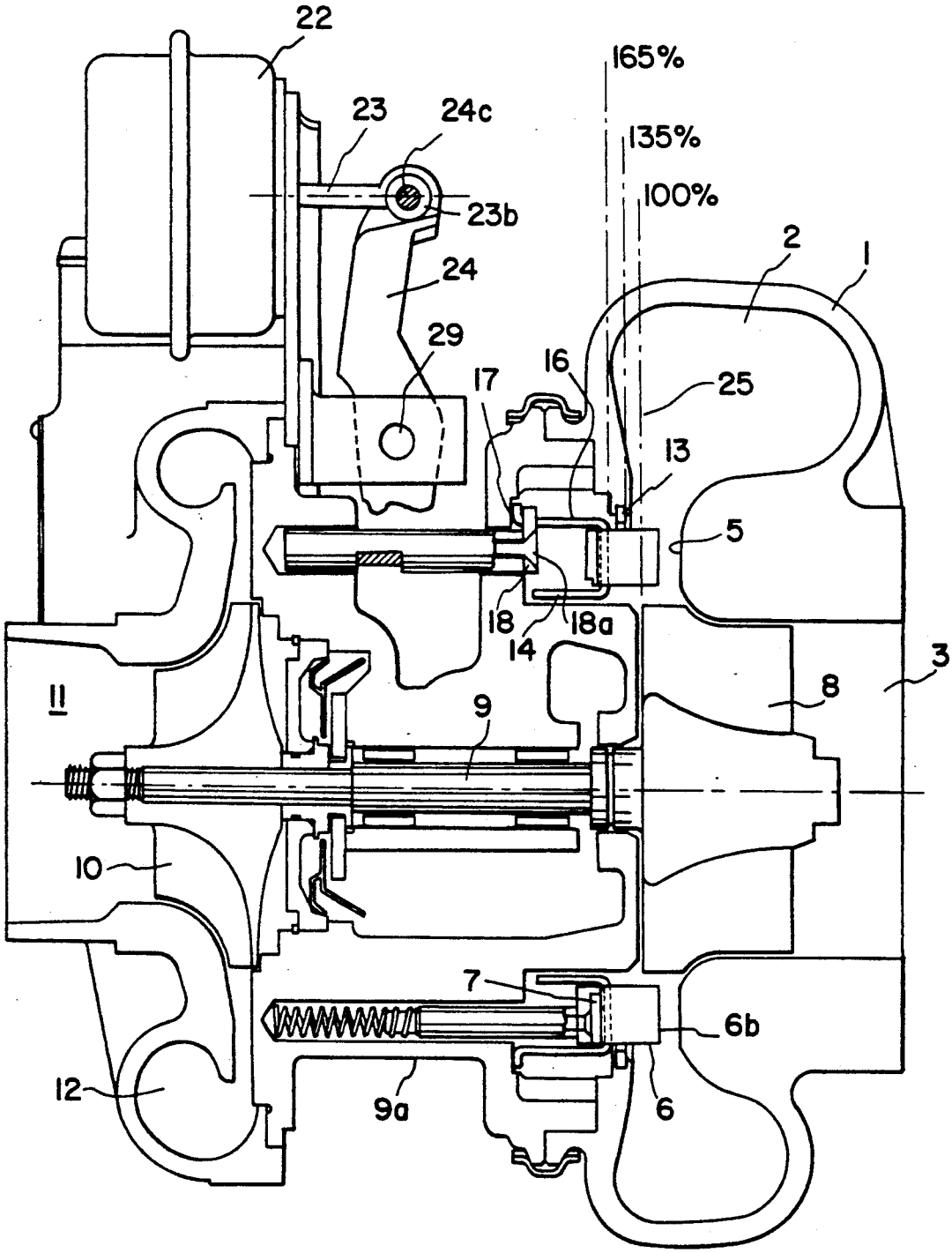

A pneumatically operated actuator 22, which may comprise a flexible diaphragm (not shown) mounted on one end of a movable output shaft 23, is operable to control the position of the output shaft 23. Output shaft 23 has a bush 23*a* that is linked to a stirrup member 24 by a pin 24c secured between legs 24a and 24b that engage the guide pins 19 as described later. Thus, by controlling the actuator 22, the axial position of the guide pins 19 and the movable annular wall member 4 can be controlled. FIG. 2 shows the movable annular wall member 4 in its fully closed position in which the radially extending portion 15 of the member 4 abuts the facing wall 5 of the inlet passageway. FIG. 3 shows the annular wall member 4 in a half open position and FIG. 4 shows the annular wall member 4 in a fully open position. As the actuator 22 is positioned at a considerable distance from the turbine axis, space is not a problem. Furthermore, the precise radial position of the actuator shaft 23 is not critical, allowing tolerances to be increased. Equally, radial expansion due to thermal distortion is not a critical problem.

Referring to FIG. 4, a dotted line 25 indicates an imaginary surface which is substantially coplanar with the end surface of the vanes of the turbine wheel 8, downstream of the movable member 4. This surface in effect defines one side of the inlet passageway to the turbine housing 1. When the wall of the inlet passageway defined by the movable annular wall member 4 is aligned with the imaginary surface 25, the spacing between the annular wall member 4 and the facing wall 5 is, for the purposes of the present description, deemed to correspond to the inlet width of the turbine inlet passageway downstream of the vanes 6. This condition is referred to below as 100% of nominal inlet width. When the movable annular wall member 4 is in the "100% of nominal inlet width" position the free ends 6b of the vanes 6 are still in contact with the facing wall 5. As the annular wall member 4 moves farther away from the facing wall 5 the gap between the rear face 15a of the radially extending annular portion 15 and the nozzle supporting ring 7 is reduced until the two come into contact. This occurs when the spacing between the annular portion 5 and the facing surface 5 corresponds to 135% of the nominal inlet passageway inlet width. Further movement of the annular wall member 4 away from the facing wall 5 results in the nozzle supporting ring 7 moving with the annular wall member 4. Accordingly, the free ends 6b of the vanes 6 are pulled back from the facing wall 5 and a gap therefore develops in the inlet passageway between the free ends 6b of the vanes 6 and the facing wall 5. This increases the effective area of the inlet passageway. When the annular wall member 4 is fully retracted (FIG. 4) the position of annular portion 15 corresponds to 165% of the nominal inlet passageway width.

Figure 5:
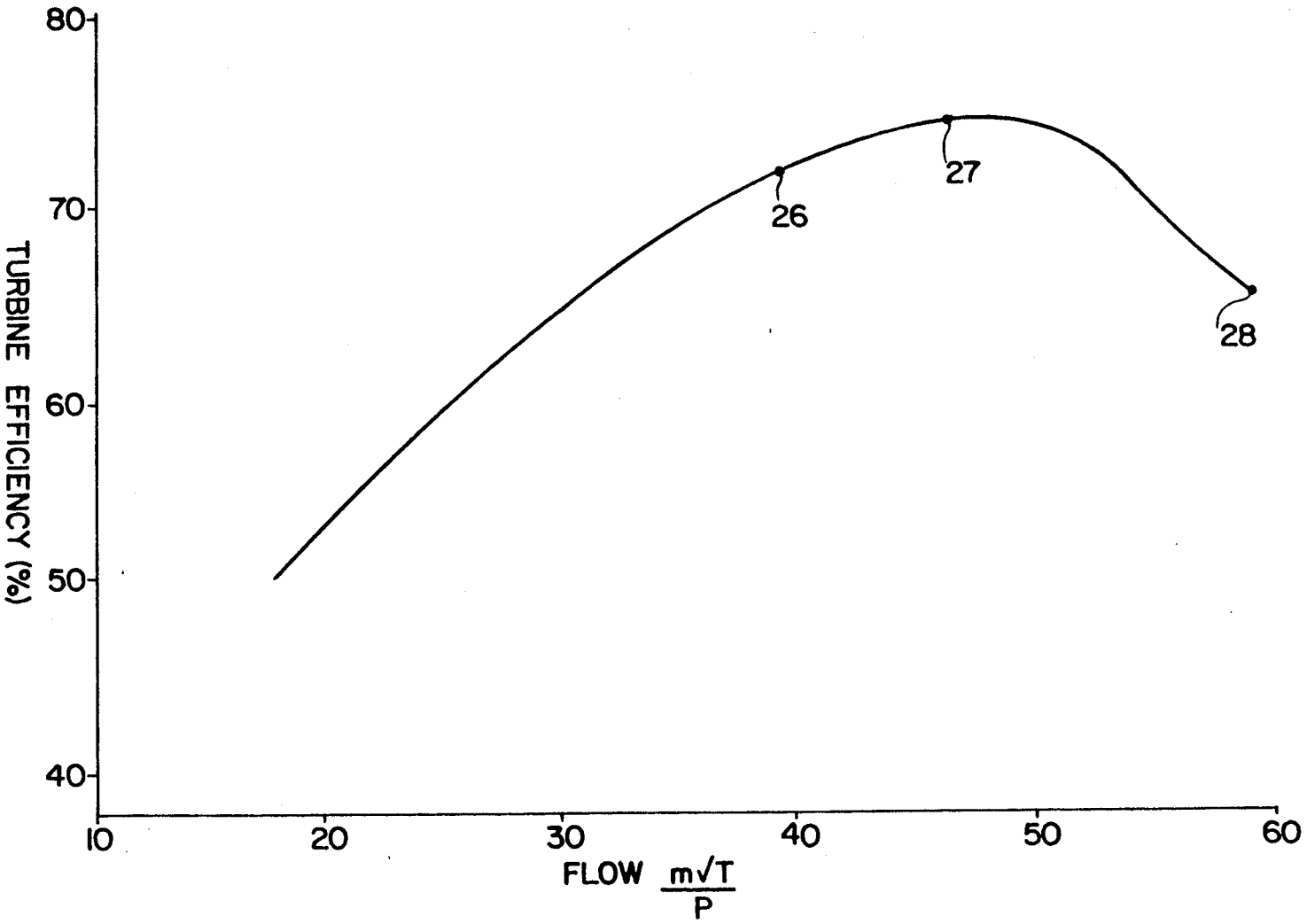
FIG. 5 is a representation of the relationship between turbine efficiency and mass flow through the turbine of FIG. 1, at a constant expansion ratio.

FIG. 5 illustrates the effect on turbine efficiency of movements of the annular wall member 4 and the nozzle support 7. The point on the curve corresponding to 100% of nominal inlet width is indicated by numeral 26. The points on the curve corresponding to 135% opening and 165% opening are indicated by numerals 27 and 28 respectively. Thus it can be seen that by providing for the annular wall member 4 to open well beyond the nominal 100% position and by providing for partial retraction at least of the nozzle vanes 6 the operational characteristics of the turbine can be modified to increase the proportion of those operating characteristics which lie within a high efficiency region of the performance curve. Essentially, for a given flow range (corresponding to a fixed distance parallel to the flow axis) the ability to extend the characteristic curve to point 28 increases the mean turbine efficiency by avoiding operating the turbine in the less efficient region indicated by the left-hand end of the curve in FIG. 5.

Figure 6:
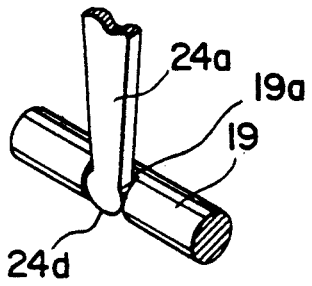
FIG. 6 illustrates the interrelationship between guide pins supporting a movable wall member of the arrangement of FIGS. 1 to 4 and a stirrup member which controls the position of those guide pins.

Referring now to FIG. 6, this shows the interengagement between one of the stirrups 24 and one of the guide pins 19 upon which the movable annular wall member 4 is mounted. The pins 19 are received in holes 19a and bore 19b in the bearing housing 9a. The two ends of the stirrup legs 24a and 24b are received in slots 19c cut in side surfaces of pins 19. The edges 24d of the leg ends which bear against the ends of the slots are curved so that the clearance the ends of legs 24a and 24 and the slot ends is constant. The legs 24a and 24b of stirrup 24 are pivoted on pivot pins 29 supported on frame 29a so that the stirrup 24 forms a lever which can be moved to precisely position the pins 19. The frame 29a is secured to housing 10a and also forms a mounting for the actuator 22. The stirrup 24 is formed from sheet steel arranged such that the stirrup is relatively stiff in the direction parallel to the axis of pins 19 but relatively flexible perpendicular to the pins. Thus transverse forces on the pins 19 are minimized, thereby reducing the probability of the pins 19 jamming in the holes 19a and bores 19b within which they slide. Furthermore, as the stirrup 24 engages central portions of the pins 19 the bearings in which the pins 19 are mounted are relatively widely spaced.

Figure 7:
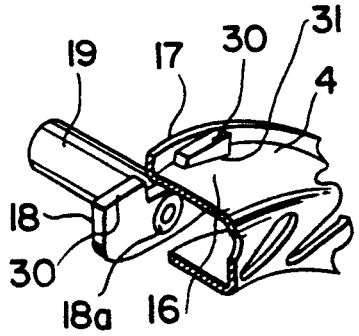
FIG. 7 illustrates the interrelationship between a guide pin of the type illustrated in FIG. 6 and a movable wall member.

FIG. 7 illustrates the interengagement between the guide pins 19 and the annular wall member 4. The member 4 is exposed to large variations in temperature and pressure and can accordingly distort and expand to a certain degree. If the linkage between the member 4 and the pin 19 was rigid such distortion would apply significant transverse forces to the pins 19. Accordingly the engagement between the member 4 and 19 is such that distortion of the member 4 can be accommodated without applying transverse forces to the pins 19.

As shown in FIG. 7 this is achieved by rigidly mounting a bridge link plate 18 or projection on the end of each pin 19 by means of screws 18a. Two spaced tabs 30 of the bridge link 18 extend radially outward and are received in corresponding spaced slots 31 formed in the tubular portion 16 of the member 4 adjacent the flange 17. The result is a structure which is adequately rigid in the direction of the axis of the pins 19 to ensure close control of the axial position of the member 4 with very little play or clearance but which is sufficiently loose in the radial and circumferential directions to accommodate thermal distortions or expansions of the member 4. The member 4 is in effect located along the vanes 6 and thus the member 4 is maintained in position despite its relatively loose mounting.

The bridge links 18 can be thicker than the flange 17 to maintain a stiff joint in the axial direction, and the width of the links 18 maintains a good resistance to tilting of the member 4 relative to the turbine axis.

Figure 8:
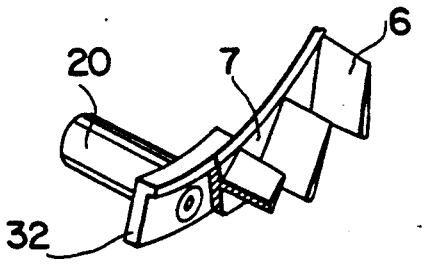
FIG. 8 illustrates the mounting of a nozzle vane support ring incorporated in the arrangement of FIGS. 1 to 4.

Referring now to FIG. 8, this illustrates the interrelationship between the spring biased support pins 20 and the nozzle support 7 on which the vanes 6 are mounted. Each pin 20 has rigidly mounted on its end a bracket 32 which has a flat surface engaging the rear side of the nozzle support ring 7 and an inner edge which is flanged to engage inside the radially inner edge of the nozzle support ring 7.

The illustrated arrangement comprises a single annular seal 13 arranged around the radially outer side of the movable wall member 4. Alternative sealing arrangements are possible, however, for example a pair of seals arranged respectively on the radially inner and outer portions of the movable annular wall member 4.

While a preferred embodiment of the present invention has been described, it should be apparent to those skilled in the art that other forms may be employed without departing from the spirit and scope thereof.

Having thus described the invention, what is claimed as novel and desired to be secured by Letters Patent of the United States is:

1. A mounting assembly for a movable annular wall member of an inlet passageway of a variable geometry turbine, wherein the inlet passageway is defined between the movable wall member and a facing wall, the movable wall member being formed from a sheet material, and the movable wall member being supported on a plurality of guide elements which are movable parallel to its direction of movement, the improvement comprising means for interconnecting said movable wall member and said guide elements with a relatively close fit in the direction of movement of said movable wall member and a relatively loose fit in a plane at right angles to the direction of movement of said movable wall member.

2. Apparatus as in claim 1 wherein said interconnecting means comprises:

means for providing a projection extending from said guide elements in a plane at right angles to the direction of movement of said movable wall member; and means on said movable wall member for embracing said projection means with a relatively tight clearance in the direction of movement of said movable wall member and a relatively loose clearance in a plane at right angles to the direction of movement of said movable wall member.

3. Apparatus as in claim 2 wherein said embracing means comprises means for forming slots on said movable wall member, said slots extending in a circumferential direction.

4. A mounting assembly for a movable annular wall member of an inlet passageway of a variable geometry turbine, wherein the inlet passageway is defined between the movable wall member and a facing wall, the movable wall member being formed from sheet material and further comprising a tubular portion extending away from said facing wall, and the movable wall member being supported on a plurality of guide elements comprising pins which are movable parallel to its direction of movement, the improvement comprising means for interconnecting said movable wall member and said guide elements with a relatively close fit in the direction of movement of said movable wall member and a relatively loose fit in a plane at right angles to the direction of movement of said movable wall member, said interconnecting means comprising:

a pair of spaced apart tabs for providing projections extending from said guide elements in a plane at right angles to the direction of movement of said movable wall member; and the tubular portion of said movable wall member having circumferentially extending slots embracing said tabs with a relatively tight clearance in the direction of movement of said movable wall member and a relatively loose clearance in a plane at right angles to the direction of movement of said movable wall member.

5. Apparatus as in claim 4 wherein said movable wall member further comprises a radially outwardly extending flange at one end of said tubular portion on the slot means are formed adjacent the juncture of said flange and tubular portion.

* * * * *